US007575658B2

(12) United States Patent
Grace

(10) Patent No.: US 7,575,658 B2
(45) Date of Patent: Aug. 18, 2009

(54) VACUUM WASHER DRUM

(75) Inventor: Todd S. Grace, Alpharetta, GA (US)

(73) Assignee: Andritz Inc., Glens Falls, NY (US)

( * ) Notice: Subject to any disclaimer, the term of this patent is extended or adjusted under 35 U.S.C. 154(b) by 111 days.

(21) Appl. No.: 11/953,486

(22) Filed: Dec. 10, 2007

(65) Prior Publication Data

US 2008/0087392 A1 Apr. 17, 2008

Related U.S. Application Data

(62) Division of application No. 11/210,268, filed on Aug. 24, 2005, now Pat. No. 7,347,916.

(60) Provisional application No. 60/612,522, filed on Sep. 24, 2004.

(51) Int. Cl.
*D21C 9/02* (2006.01)

(52) U.S. Cl. ..... 162/60; 162/272; 162/199; 134/119; 134/21; 210/402; 210/404

(58) Field of Classification Search ..... 162/60, 162/199, 263, 272; 134/119, 21, 33; 210/402, 210/404, 406, 784
See application file for complete search history.

(56) References Cited

U.S. PATENT DOCUMENTS

| | | | | |
|---|---|---|---|---|
| 3,225,935 | A * | 12/1965 | Porteous | 210/404 |
| 3,363,774 | A * | 1/1968 | Luthi | 210/404 |
| 3,947,361 | A * | 3/1976 | Jackson | 210/391 |
| 5,021,126 | A | 6/1991 | Gwin et al. | |
| 5,308,488 | A * | 5/1994 | Nelson | 210/404 |
| 5,480,545 | A * | 1/1996 | Lewis | 210/380.3 |

* cited by examiner

*Primary Examiner*—Mark Halpern
(74) *Attorney, Agent, or Firm*—Nixon & Vanderhye P.C.

(57) ABSTRACT

A vacuum drum washer is designed to enable the use of an end-draining drum for drum lengths exceeding 20 feet. The drum washer includes a cylindrical drum having a mesh screen defining an exterior wall. A plurality of outer filtrate channels are disposed radially inward from the mesh screen. A plurality of inner filtrate channels are disposed radially inward from the outer filtrate channels and extend along generally less than an entire length of the drum. A transfer channel connects the outer filtrate channels and the inner filtrate channels. A plurality of radial drainage chutes are disposed adjacent a head end of the outer and inner filtrate channels, which direct the filtrate to a drain valve.

2 Claims, 5 Drawing Sheets

VACUUM WASHER DRUM

CROSS-REFERENCES TO RELATED APPLICATIONS

This application is a divisional of U.S. patent application Ser. No. 11/210,268, filed Aug. 24, 2005, now U.S. Pat. No. 7,347,916, which claims the benefit of U.S. Provisional Patent Application Ser. No. 60/612,522, filed Sep. 24, 2004, the entire contents of each of which are hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to vacuum drum washers and, more particularly, to a vacuum drum washer used for washing pulp in a paper making process.

The assignee of the present invention currently supplies two styles of drums—the so-called BMax (shown in FIGS. 1 and 2) and the so-called VMax (shown in FIG. 3). The BMax is commonly referred to as an "end-draining" drum since all of the filtrate moves to the end (lengthwise) of the drum through annular channels located beneath the deck. In the BMax, the filtrate is then transferred to the valve area of the drum via radial channels built into the head of the drum.

The VMax is commonly referred to as a "center-draining" drum since all of the filtrate moves to the middle (lengthwise) of the drum through annular channels located beneath the deck. In the VMax, the filtrate is then transferred to the valve area of the drum via pipes (see FIG. 3).

The annular channels (shown in FIGS. 1 and 3) beneath the deck in both the BMax and VMax are referred to as filtrate channels.

End-draining drums are typically used for drums that are ≦20' in length (sometimes longer, depending on the application). Center-draining drums are typically used for drums>20' in length. The length criteria is based on limiting the distance filtrate has to travel when the volume is high, thereby reducing the pressure drop. Up until the early 1990's, most drums were of the center-draining design. The end-draining type drum was designed to lower the cost, and to simplify the drum construction for better maintainability.

An example of an existing drum is described in U.S. Pat. No. 5,021,126, the contents of which are hereby incorporated by reference.

A problem with the existing designs, however, is that the center-draining drum is costly, which has been amplified by the rising cost of steel.

BRIEF SUMMARY OF THE INVENTION

It would thus be desirable to design a drum washer that encompasses the simplified construction of an end-draining drum while being able to function properly for use with drums that are greater than 20 feet in length. The drum design according to the present invention incorporates a second filtrate channel at least partially along the length of the drum. Filtrate from the tail end of the drum travels about half the length of the drum, then passes beneath the filtrate channel through the opposite end of the drum. Thus, for about half or more of the drum closest to the end-draining area, there are two filtrate channels disposed one on top of the other.

In an exemplary embodiment of the invention, a vacuum drum washer includes a cylindrical drum including a mesh screen defining an exterior wall. A plurality of outer filtrate channels are disposed radially inward from the mesh screen and extend along a longitudinal axis of the drum and substantially an entire length of the drum. A plurality of inner filtrate channels are disposed radially inward from the outer filtrate channels and extend along the longitudinal axis of the drum and less than an entire length of the drum. A transfer channel connects the outer filtrate channels and the inner filtrate channels. A plurality of radial drainage chutes are disposed adjacent a head end of the outer and inner filtrate channels, which radial drainage chutes direct filtrate to a drain valve.

A downstream end of the transfer channel is preferably disposed in fluid communication with a start of the inner filtrate channels. An upstream end of the transfer channel is preferably disposed between a start and an end of the outer filtrate channels. In particular, an upstream end of the transfer channel may be disposed substantially half way between a start and an end of the outer filtrate channels.

In another exemplary embodiment of the invention, a vacuum drum washer includes a cylindrical drum including a mesh screen defining an exterior wall, a first plurality of filtrate channels disposed radially inward from the mesh screen, a second plurality of filtrate channels disposed radially inward from the first plurality of filtrate channels, where a transfer channel connects the first plurality of filtrate channels and the second plurality of filtrate channels, and a plurality of radial drainage chutes disposed adjacent a head end of the first and second pluralities of filtrate channels, which direct filtrate to a drain valve.

In yet another exemplary embodiment of the invention, a method of washing pulp for the manufacture of paper includes the steps of rotating a cylindrical drum having a mesh screen defining an exterior wall in a vat of pulp; applying a vacuum within the cylindrical drum until a pulp mat is deposited on the exterior wall; applying a washing liquid to the pulp mat on the exterior wall, the washing liquid flowing as filtrate through the pulp mat and through the mesh screen into a plurality of outer filtrate channels disposed radially inward from the mesh screen; diverting at least a portion of the filtrate into a plurality of inner filtrate channels disposed radially inward from the outer filtrate channels via a transfer channel connecting the outer filtrate channels and the inner filtrate channels; and directing the filtrate to a drain valve via a plurality of radial drainage chutes disposed adjacent a head end of the outer and inner filtrate channels. A downstream end of the transfer channel is disposed in fluid communication with a start of the inner filtrate channels, where the diverting step is practiced by diverting the portion of the filtrate from the outer filtrate channels to the start of the inner filtrate channels.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
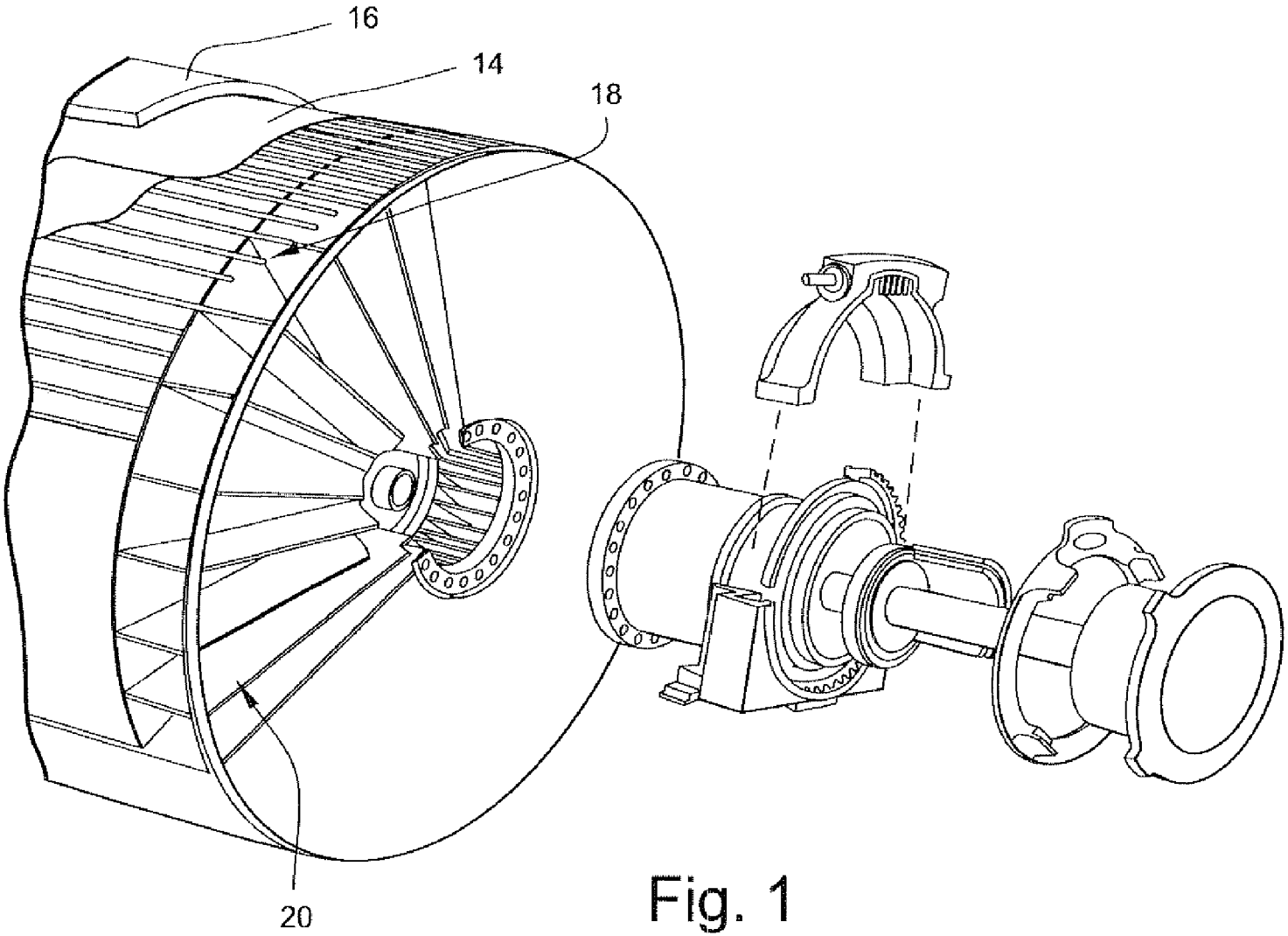
FIG. 1 illustrates a conventional end-draining washer drum.
Figure 2:
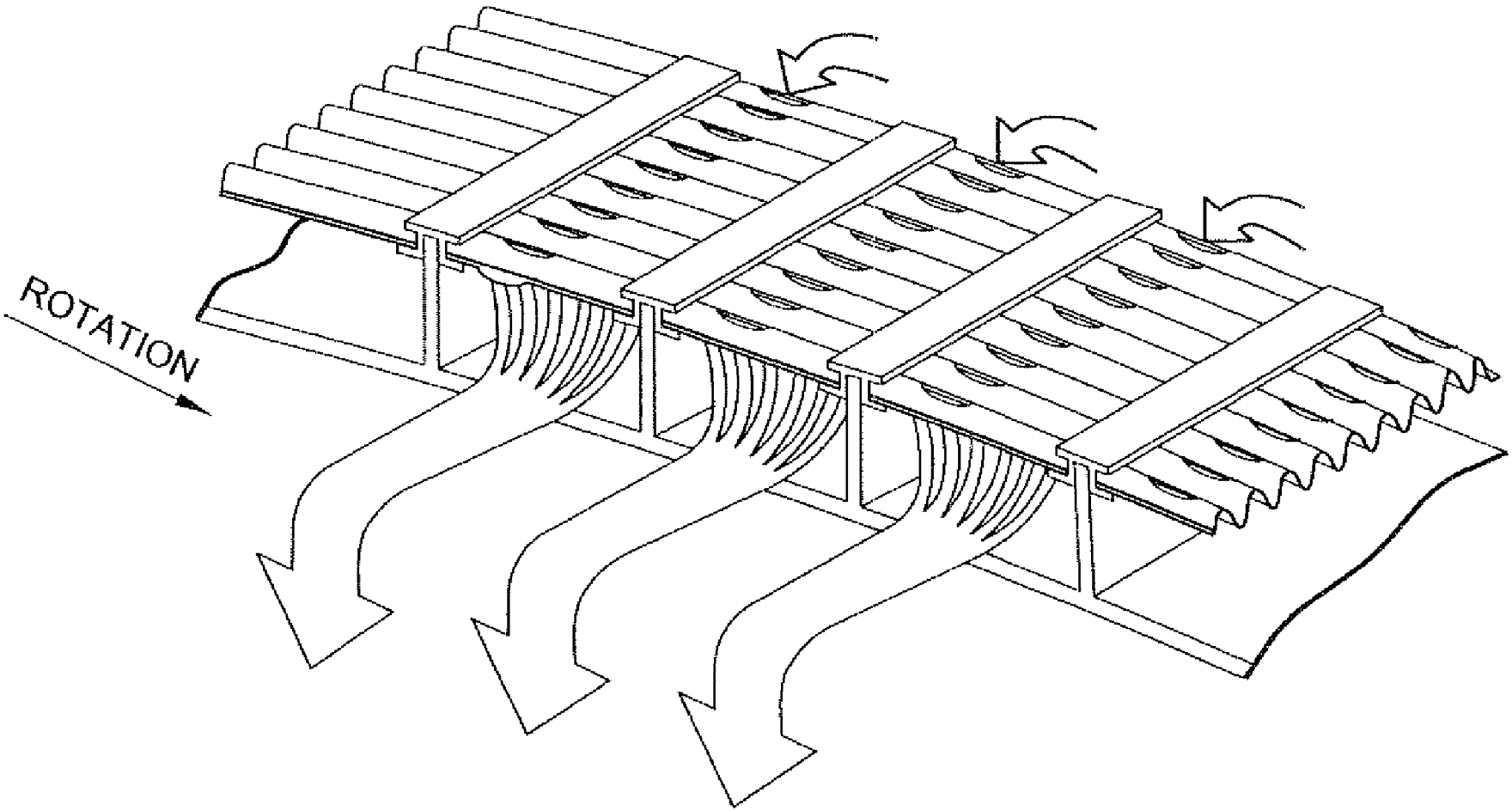
FIG. 2 illustrates filtrate channels of the conventional drum washer shown in FIG. 1.
Figure 3:
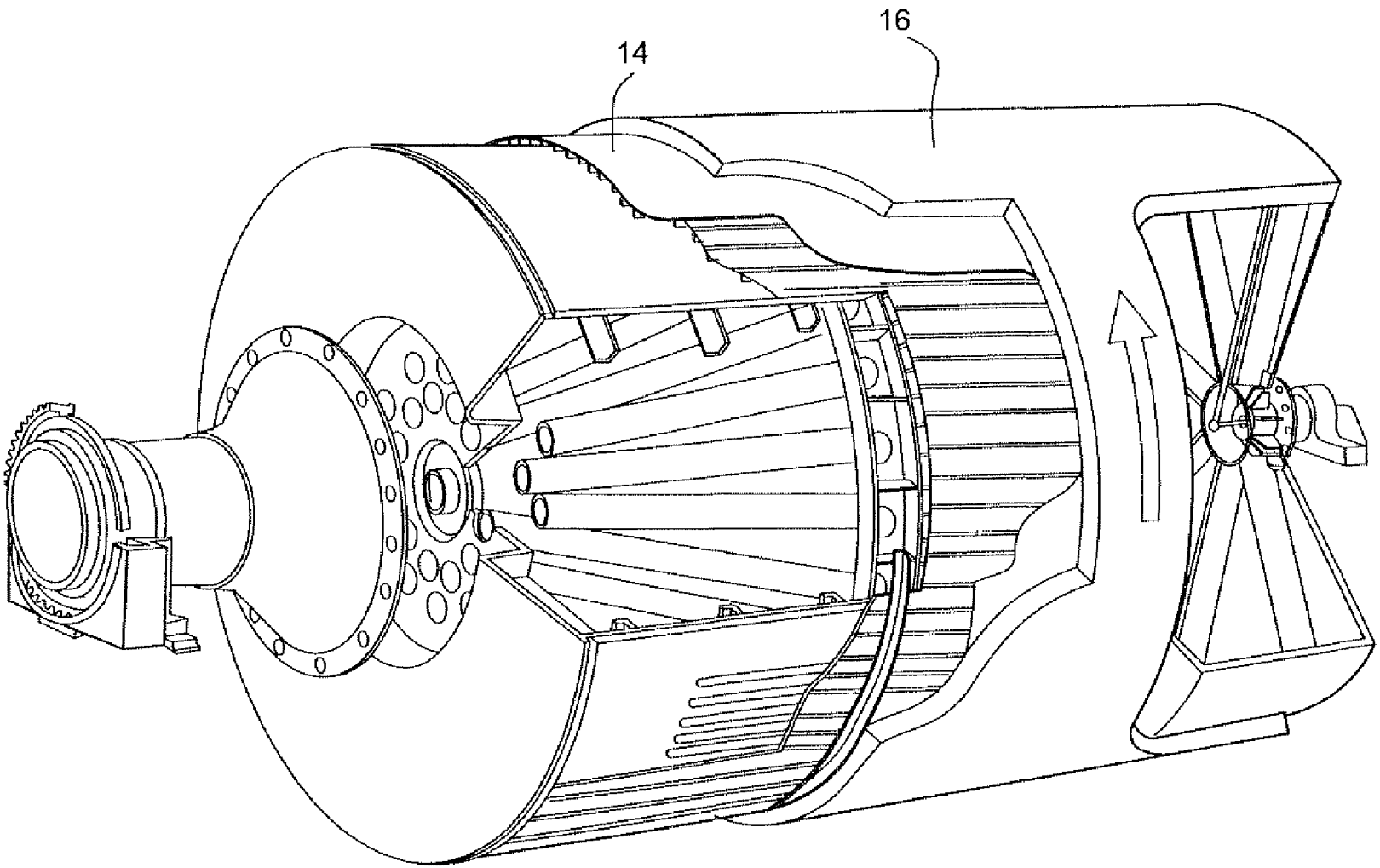
Fig. 3 (PRIOR ART)
FIG. 3 illustrates a conventional center draining drum.

In a paper manufacturing process, a pulp material is typically washed to remove pulping liquors and the like. Depending on a length of the drum washer in use, either of the conventional drum washers discussed above is typically used. The drum washer 10 is generally formed of a cylindrical drum 12 including a fine mesh screen 14 defining an exterior wall. See FIGS. 1, 3, 4 and 5. The drum washer 10 is rotated continuously through a vat slurry of pulp material, and a vacuum is supplied within the cylinder for at least a portion of the rotation. A pulp mat 16 is thus deposited on the mesh screen 14, and a liquid cleansing material is applied to the mat 16 to effect washing of the pulp mat 16. The cleansing liquid that flows through the pulp mat 16 also flows through the mesh wall 14 of the drum washer 10 and into a plurality of longitudinal filtrate channels 18. When the vacuum is cut off, the pulp mat 16 can be removed from the cylindrical drum 12. In the conventional arrangement, the filtrate is drained from the pulp mat 16, and the filtrate channels 18 direct the filtrate to a valve chamber including drainage chutes 20 (FIG. 1) at the end of the cylinder. Subsequently, the filtrate is drained via a drop leg 22.

As discussed above, it is desirable to utilize an end-draining drum as such drums are less expensive to manufacture and maintain. In a configuration where the washer drum exceeds about 20 feet in length, however, conventional end-draining drums have difficulty draining the filtrate due to the pressure drop associated with the large volume of filtrate flowing in the filtrate channels. The structure of the present invention is designed to reduce the pressure drop particularly toward the drain end of the drum so that an end-draining drum can be used for drums exceeding 20 feet in length.

Figure 4:
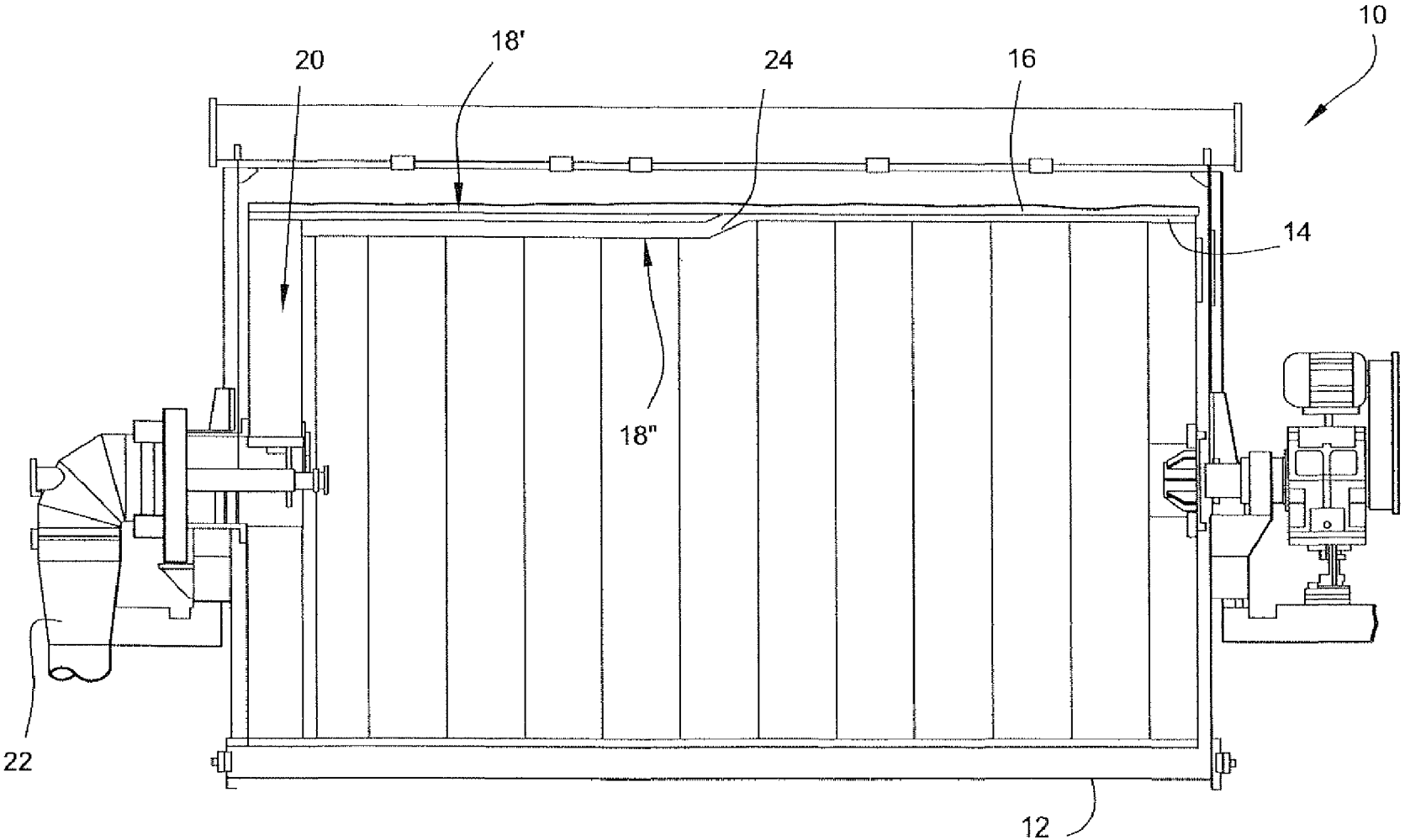
FIG. 4 is a sectional cutaway view of the drum washer according to the present invention.
Figure 5:
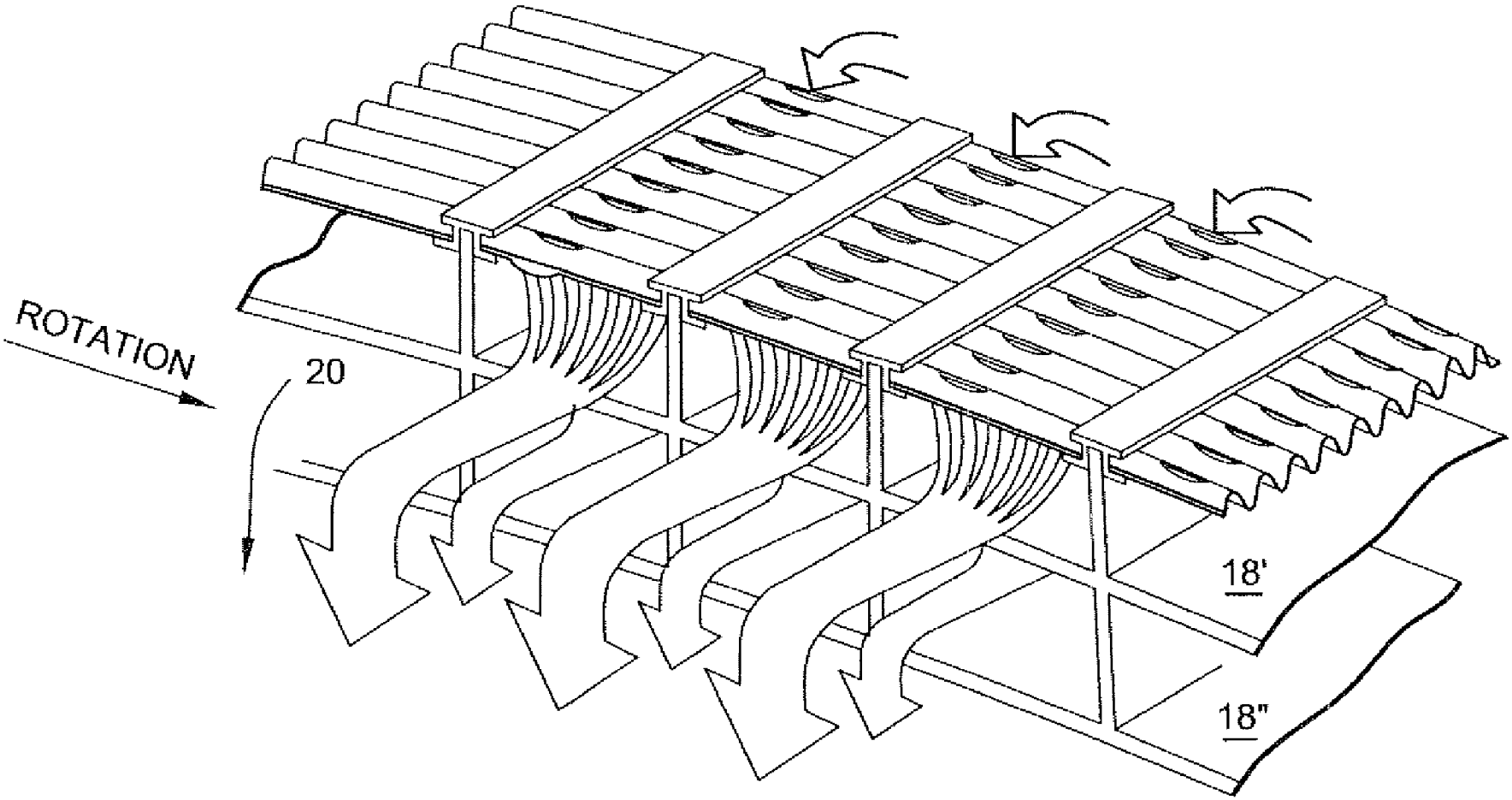
FIG. 5 illustrates the stacked filtrate channels of the present invention.

With continued reference to FIGS. 4 and 5, the end-draining drum washer 10 of the invention is provided with a plurality of outer filtrate channels 18' disposed radially inward from the mesh screen exterior wall 14 and additionally includes a plurality of inner filtrate channels 18" disposed radially inward from the outer filtrate channels 18'. The outer filtrate channels 18' extend along a longitudinal axis of the drum 10 and substantially along an entire length of the drum 10. The inner filtrate channels 18" also extend along the longitudinal axis of the drum although preferably less than an entire length of the drum as shown in FIG. 4. A transfer channel 24 connects the outer filtrate channels 18' and the inner filtrate channels 18". As shown in FIG. 5, the outer and inner filtrate channels 18', 18" direct filtrate to the radial drainage chutes 20 disposed adjacent the head end of the filtrate channels 18', 18". Similar to the conventional design, the radial drainage chutes 20 direct filtrate to a drain valve or drop leg 22. A curved plate at the radial channel ends of the outer and inner filtrate channels 18', 18" may be provided to turn the filtrate from each of the filtrate channels 18', 18" into the radial channels 20 in the head of the drum.

In a preferred arrangement, a downstream end of the transfer channel 24 is disposed in fluid communication with a start of the inner filtrate channels 18". Also, an upstream end of the transfer channel 24 is disposed at a midpoint, preferably substantially halfway, between a start and an end of the outer filtrate channels 18'. As shown, the inner filtrate channels 18" extend along about half the length of the drum.

The drum may be assembled in any suitable manner as would be apparent to those of ordinary skill in the art. With continued reference to FIG. 4, the right side of the drum (in FIG. 4) has only one filtrate channel, and the left side of the drum has both an inner and an outer filtrate channel. The drum may be assembled such that a first filtrate channel is completed for the entire length of the drum. The grids (the radial dividers that form the filtrate channels) are then added to create a single outer diameter for the entire length of the drum (the grids on the left are preferably longer than those on the right). The bottom of the second filtrate channel on the left side would then be added between the grids.

With the drum construction of the present invention, the volume of filtrate in the outer filtrate channels 18' in the front end of the drum 10 is deflected via the transfer channel 24 to the inner filtrate channels 18" toward the second half of the drum 10. As a consequence, the filtrate in the inner channels 18" is not subjected to the pressure drop associated with filtrate entering the outer channels 18' toward the second half of the drum 10. As a consequence, a pressure drop through the outer filtrate channels 18' is reduced.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of washing pulp for the manufacture of paper, the method comprising:

rotating a cylindrical drum having a mesh screen defining an exterior wall in a vat of pulp;

applying a vacuum within the cylindrical drum until a pulp mat is deposited on the exterior wall;

applying a washing liquid to the pulp mat on the exterior wall, the washing liquid flowing as filtrate through the pulp mat and through the mesh screen into a plurality of outer filtrate channels disposed radially inward from the mesh screen;

diverting at least a portion of the filtrate into a plurality of inner filtrate channels disposed radially inward from the outer filtrate channels via a transfer channel connecting the outer filtrate channels and the inner filtrate channels; and directing the filtrate to a drain valve via a plurality of radial drainage chutes disposed adjacent a head end of the outer and inner filtrate channels.

2. A method according to claim 1, wherein a downstream end of the transfer channel is disposed in fluid communication with a start of the inner filtrate channels, and wherein the diverting step is practiced by diverting the portion of the filtrate from the outer filtrate channels to the start of the inner filtrate channels.

* * * * *